US005205497A

United States Patent [19]

Deklerow

[11] Patent Number: 5,205,497

[45] Date of Patent: Apr. 27, 1993

[54] FLUORESCENT LAMP CRUSHER

[75] Inventor: Joseph W. Deklerow, Rochester, N.Y.

[73] Assignee: Dextrite, Inc., Rochester, N.Y.

[21] Appl. No.: 928,721

[22] Filed: Aug. 13, 1992

[51] Int. Cl.[5] ..... B02C 19/14

[52] U.S. Cl. ..... 241/36; 241/37.5; 241/99; 241/100; 241/DIG. 14; 340/635

[58] Field of Search ..... 241/99, DIG. 14, 375, 241/36, 100; 340/635

[56] References Cited

U.S. PATENT DOCUMENTS

| | | | |
|---|---|---|---|
| 2,308,578 | 1/1943 | White et al. | 241/100 |
| 3,623,672 | 11/1971 | DeFrank | 241/37.5 |
| 4,269,364 | 3/1981 | Moriconi et al. | 241/99 X |
| 4,579,287 | 4/1986 | Brown | 241/37.5 X |
| 4,607,798 | 8/1986 | Odlin | 241/99 |
| 4,619,409 | 10/1986 | Harper et al. | 241/99 X |
| 4,655,404 | 4/1987 | Dekleron | 241/99 |

FOREIGN PATENT DOCUMENTS

| | | | |
|---|---|---|---|
| 2817740 | 10/1979 | Fed. Rep. of Germany | 241/100 |
| 3005663 | 8/1981 | Fed. Rep. of Germany | 241/100 |

*Primary Examiner*—Mark Rosenbaum
*Assistant Examiner*—Frances Chin
*Attorney, Agent, or Firm*—Shlesinger, Fitzsimmons & Shlesinger

[57] ABSTRACT

A lamp crusher housing is mounted on the removable cover of a replaceable waste container to discharge crushed lamps into the waste container through an opening in the cover. An elongate, plastic sleeve is removably and sealingly secured at one end over the upper end of the waste container, and at its opposite end around the outlet of the housing from which crushed lamp particles are discharged. The sleeve has an excess portion folded into the waste container so that when the cover is lifted from the container opposite ends of the sleeve bag remained sealingly connected to the waste container and housing outlet so that no toxic gases are allowed accidentally to escape into their surrounding atmosphere. The apparatus includes a replaceable filter cartridge for filtering out mercury vapors, and the like. Each cartridge contains a fuse which is connected in the circuit that controls the motor that drives the lamp crusher. When a new cartridge is placed in the apparatus its fuse is connected into the control circuit and permits only a predetermined number of lamp crushing operations to occur, after which the motor will be prevented from further operation until the saturated cartridge is replaced by a new, clean cartridge.

18 Claims, 3 Drawing Sheets

FLUORESCENT LAMP CRUSHER

BACKGROUND OF THE INVENTION

This invention relates to fluorescent lamp crushers, and more particularly to an improved crusher of the type described which has incorporated therein control means for automatically preventing operation of the crusher whenever its associated filter element becomes saturated. This invention relates also to an improved method for removing an associated crushed lamp waste receptacle from the crusher without permitting any toxic mercury vapors from entering the atmosphere.

In my U.S. Pat. No. 4,655,404 I have disclosed a fluorescent lamp crusher device which includes a replaceable filter cartridge for capturing or otherwise removing mercury vapors which are released upon the crushing of fluorescent lamps. Replaceable cartridges of the type described above include activated carbon, which is very effective in removing objectionable mercury vapors from the air during operation of the crusher, provided that the charcoal or carbon particles be replaced or replenished whenever they become saturated with mercury.

Accordingly, in order to prevent mercury vapors from entering the air in the vicinity of the crusher, it is essential that the above-noted filter cartridge be replaced as soon as it becomes saturated and is no longer effective. Although it is customary to provide the crusher device with a warning lamp or signal to indicate when the cartridge should be replaced, this warning device often is not heeded, and as a consequence the cartridges are not timely replaced. This can lead to dangerous discharge of mercury vapors into the surrounding air.

Still another problem encountered with crushers of the type described is that, whenever it becomes necessary to remove or replace the associated waste receptacle, it is possible that residual mercury vapors will be discharged into the air. In practice it has been customary to employ in the drum or waste retainer associated with the crusher, a plastic bag, which can be closed and removed from the bucket when it becomes full. Even then, however, it is necessary to remove the lower end of the crusher from the bag, and during this operation mercury vapors can be discharged into the surrounding air.

Accordingly, it is an object of this invention to provide for lamp crushers of the type described improved safety means which automatically shut down the equipment and prevent further operation thereof whenever the associated filter cartridge has become saturated.

It is an object also of this invention to provide an improved apparatus for preventing undesirable mercury vapors from being discharged into the surrounding air whenever the waste receptacle associated with the crusher has to be replaced.

Other objects of this invention will be apparent hereinafter from the specification and from the recital of the appended claims, particularly when read in conjunction with the accompanying drawings.

SUMMARY OF THE INVENTION

This device has two improvements which further limits the amount of mercury vapor exposed to the operator and the surrounding environment during operation of the device and disposal of the waste. The first of these improvements is an improved control circuit which safeguards against operation of the device after the filter has become saturated with mercury vapor, by means of a fuse incorporated into the filter cartridge. A counting mechanism records each crushing event, and this determines when the device will be shut down based upon the least number of fluorescent lamps which will cause the carbon filter to become saturated. In one embodiment, after a new cartridge has been installed and power is supplied to the control circuit, the fuse in the filter cartridge blows, and at the same time the counter is reset to zero and the warning notices are cleared so that operation of the device may commence until the maximum number of crushing events has again been reached. When the predetermined maximum number of crushing events is reached for the new filter, the warning notices appear and the device automatically shuts down, thereby preventing operation of the device and mandating replacement of the fuse and filter cartridge. The near-saturated filter cartridge may then be disposed of properly.

The second improvement is a design modification which limits the amount of residual mercury vapor that may escape into the surrounding environment during use of the device and during replacement of its waste drum. A plastic sleeve encompassing the crusher opening in the lid extends to the opening of the waste drum, which it also encompasses. This allows the cover plates to be elevated from the waste drum without exposing mercury vapor to the operator or the surrounding environment. Once the cover plate has been elevated, the plastic sleeve may be constricted intermediate its ends by a fastener and then released from the crusher opening, which will allow the cover plate to be removed and a lid to be sealed onto the waste drum. The filled waste drum may then be disposed of properly.

THE DRAWINGS

DETAILED DESCRIPTION OF THE PREFERRED EMBODIMENTS

Figure 1:
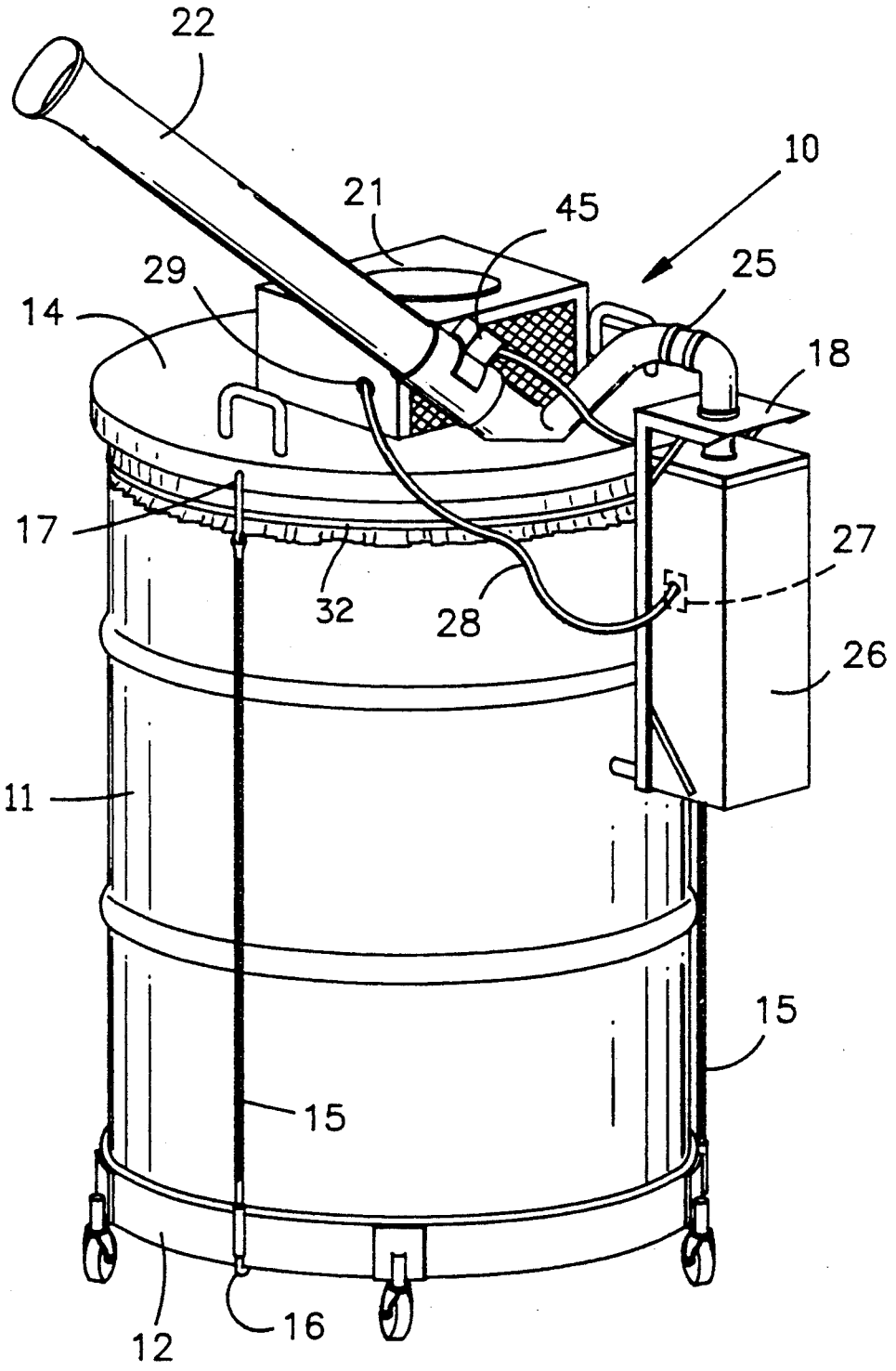
FIG. 1 is a perspective view illustrating in elevation an improved lamp crusher mechanism made according to one embodiment of this invention.
Figure 2:
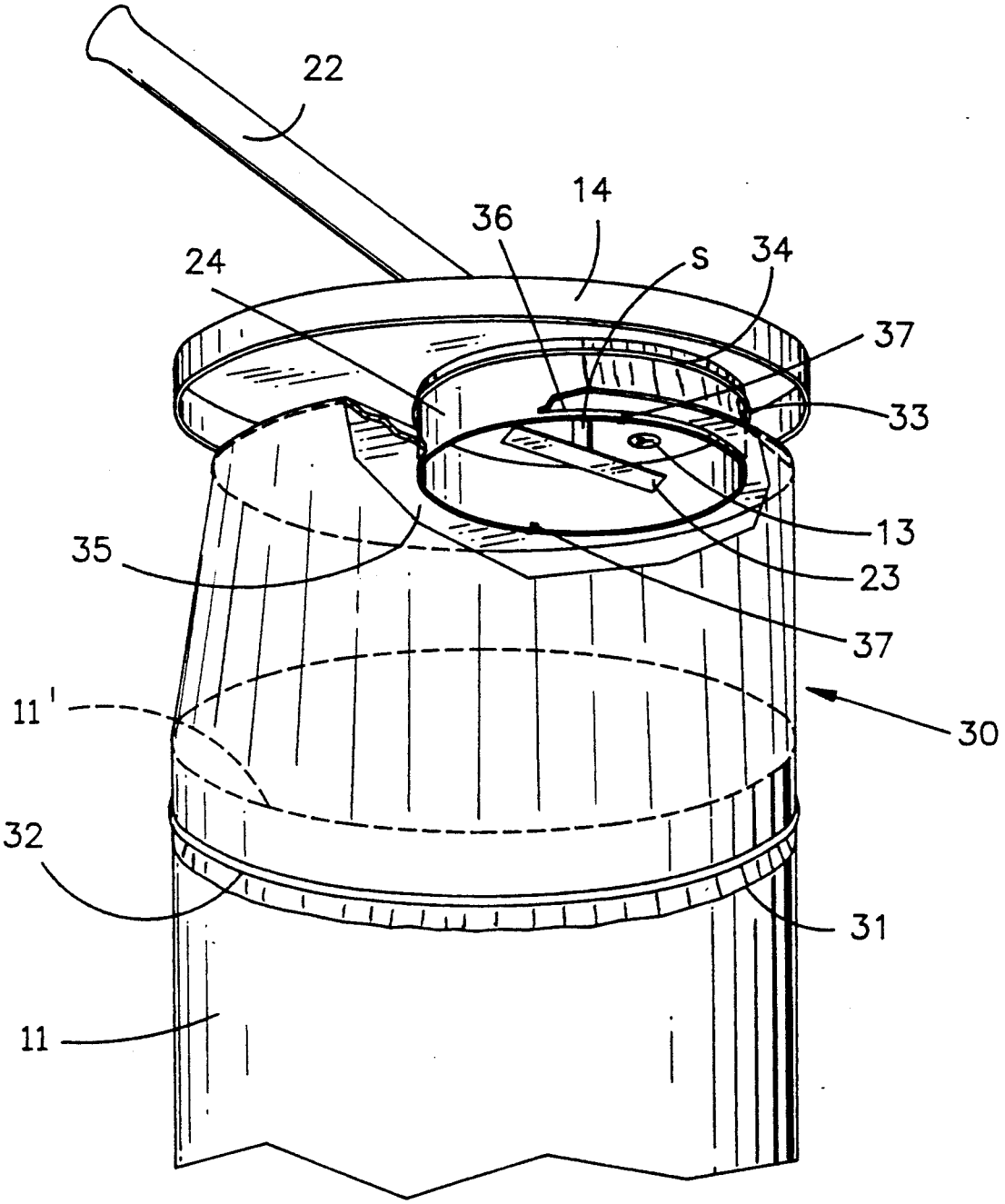
FIG. 2 is a fragmentary perspective view of this mechanism with the cover of the waste receptacle removed and positioned above the receptacle to show the plastic sleeve which connects the receptacle to the bottom of the crusher housing.

Referring now to the drawings by numerals of reference, and first to FIGS. 1 and 2, 10 denotes generally a fluorescent lamp crushing apparatus comprising a cylindrical waste receptacle or drum 11, which is removably mounted on a wheeled carriage 12 of conventional design. As shown in FIG. 1, drum 11 has removably secured thereover a circular cover plate 14, which is held releasably over the upper end of the drum 11 by a plurality of elastic cords 15. Cords 15 have fastened to opposite ends thereof hooks 16 and 17 which engage, respectively, beneath the bottom of the carriage 12 and the top of cover plate 14. Although only one such cord or band 15 is shown in FIG. 1, it will be understood that several are to be employed around the perimeter of the drum 11. Moreover, it is to be understood also that any conventional means could be employed releasably to secure the cover 14 over the top of drum 11, the cords 15 being disclosed merely to illustrate one such conventional means.

Mounted on the upper side of cover 14 within a housing 21 is an electric motor M (FIG. 3), which may be of the type shown for example in my above-noted U.S Pat. No. 4,655,404. Secured at its lower end in registry with an opening 13 (FIG. 2) in cover 14, and projecting diagonally upwardly from the cover is a fluorescent lamp feeder tube 22, the lower end of which communicates through opening 13 with the interior of a crusher mechanism which is suspended in drum 11 beneath cover 14. The crusher mechanism includes a rectangular bar or flail 23 ( FIG. 2) which is connected to the shaft S (FIG. 2) of the motor in housing 21 for rotation thereby in an annular wall or collar 24 which is secured to and projects from the underside of cover 14 eccentrically thereof. i.e., the axis of wall 24 is radially offset slightly from the axis of cover 14. Since the crusher forms no part of this invention it has not been illustrated and described in detail herein, but for reference to the type of crusher involved, attention is again directed to my above-noted U.S. Pat. No. 4,655,404.

Figure 3:
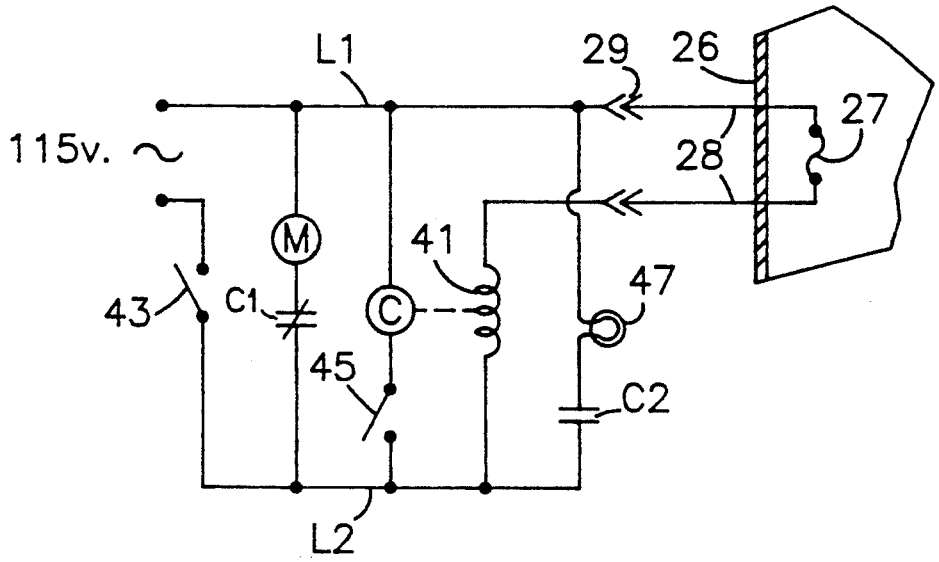
FIG. 3 is a wiring diagram illustrating part of one embodiment of the circuit which controls the operation of this improved crusher.
Figure 4:
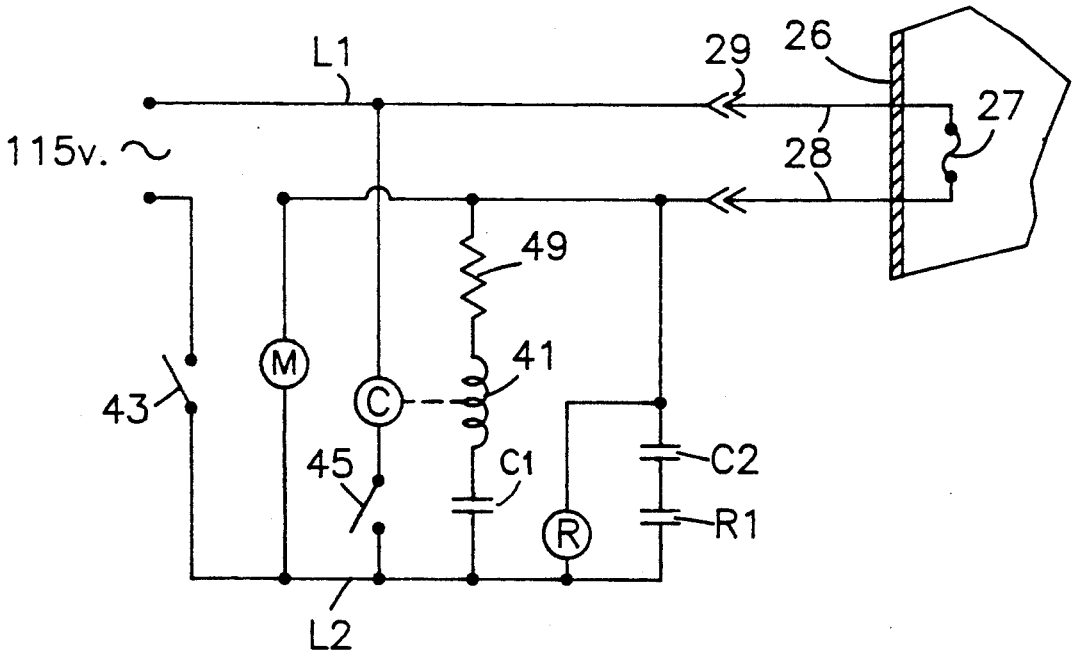
FIG. 4 is a wiring diagram which illustrates part of another embodiment of a circuit that controls the operation of this improved crusher.

Referring again to FIG. 1, numeral 25 denotes an exhaust pipe which, as disclosed in my above-noted patent, communicates at one end with the interior of the crusher adjacent the lower or discharge end of the lamp feeder tube 22, and which is releasably connected at its opposite end to the upper end of a filter cartridge 26, which is replaceably and removably mounted on a bracket 18 that is supported adjacent one side of drum 11. Cartridge 26 differs from the type shown in my above-noted U.S. Patent in that it has mounted thereon, and within cartridge 26 as shown in this embodiment, a fuse 27 (FIGS. 1, 3 and 4). Opposite ends of the fuse 27 are connected by wire leads 28 and plug 29 to a circuit controlling the operation of motor M as noted hereinafter. It will be understood that wires 28 pass from fuse 27 through a sealed opening in cartridge 26 so that no mercury vapor will escape from the cartridge during its use.

Although much of the mercury vapor is captured by the filter during the crushing event, some residual vapor does exist in the collection of waste in drum 11. Containment of such residual mercury vapor is achieved by means of an extensible duct in the form of a large, transparent, plastic sleeve 30 having a lower end 31, and a smaller upper end 33 offset from the axis of its lower end. Sleeve 30 has sealed into its diametrally larger, lower end 31 and smaller, upper end 33, elastic bands 32 and 34, respectively, by means of which the lower end 31 and upper end 33 of sleeve 30 are removably and sealingly secured about 35 the upper end 11' of drum 11 and the outside of annular wall 24, respectively. Sleeve 30 must be long enough to permit cover 14 to be elevated above drum 11 approximately to the position shown in FIG. 2, when the loaded drum is removed as noted hereinafter. For this reason, at the outset the upper end 33 of the sleeve is passed over and around a disc 35, which surrounds the lower end of annular wall 24. Disc 35 has therethrough an eccentrically disposed opening 36 that is press fit over the lower end of wall 24, and is prevented from accidentally slipping downwardly off of wall 24 during operation of the crushing device by a pair of spring clamps 37, which are releasably attached over the lower edge of wall 24 beneath disc 35. By placing the upper end 33 of sleeve 30 around disc 35, the excess or loose plastic material which exists in drum 11, when cover 14 is secured thereover, is prevented from collapsing into the region below flail 23, where ejected shards of broken glass could tear the plastic sleeve 30.

Referring now to the first embodiment of the control circuit, as illustrated in FIG. 3, the leads 28 from a fuse 27 in a new cartridge 26 are connected by their plug section 29 so that one side of fuse 27 is connected by line L1 to one side of an AC power supply of, for example, 115 volts, while the other side of fuse 27 is connected through a counter reset coil 41 to a line L2, which is connected through an On/Off switch 43 with the other side of the AC power supply. Coil 41 is designed to reset a counter C, which is connected in series between lines L1 and L2 with a normally-open counter indexing switch 45. The motor M which drives the flail 23 is also connected in series between lines L1 and L2 with a counter controlled switch C1. The motor M and the switch contacts C1 in series therewith are connected in parallel between lines L1 and L2 with the counter C and its indexing switch 45. In addition to being connected in parallel with each other, the motor M and counter C are also connected in parallel with a warning lamp 47, which is connected in series between lines L1 and L2 with another counter controlled, normally-open switch C2. As shown in the drawing switches C1 and C2 have opposite modes, and are shown in the positions they assume whenever the counter C has been reset to its zero state or operating mode.

To operate the equipment with a control circuit of the type shown in FIG. 3, it will be assumed that a new cartridge 26 has been mounted in the bracket 18, and has had its fuse 27 connected in the circuit via plug 29 as shown in FIG. 3. At this stage switch 43 is moved to its closed position to turn the control circuit ON, at which time the reset coil 41 and the fuse 27 are connected in series between the lines L1 and L2. This creates a surge of current through the fuse 27, which then blows or burns out, thus causing the coil 41 to become deenergized. However, that particular surge of current through coil 41 was sufficient to reset the counter C to its zero state, at which time the counter has caused switch C1 to close to energize motor M, and has caused switch C2 to open. Thus the warning lamp 47 which was momentarily energized upon the closing of switch 43, is now deenergized.

Fluorescent lamps can now be fed through tube 22, and in so doing each lamp will cause switch 45 to be closed, and to remain closed until the lamp has been completely crushed or destroyed. As soon as switch 45 closes, it indexes or energizes the counter C to cause the counter to start counting up towards its preset maximum. Thus, depending upon the size (length) of the lamp that is being crushed, the counter C will be indexed or energized for a given interval of time. The interval will be rather abrupt for a so-called short lamp, and more prolonged for a longer lamp. In any event, as soon as the counter has reached its preset maximum count or number, which will correspond to the number of crushed lamps it will take to saturate a respective filter 26, the counter C will count out, and therefore will open switch C1 and close switch C2. With switch C1 open, the motor M can no longer be energized, and the now-closed switch C2 will cause the lamp 47 to become illuminated. Thus, with the warning lamp on and with the motor M inoperable, the operator will realize that it is time to replace the cartridge 26. Switch 43 is then opened and the cartridge is replaced, after which the switch 43 can be reclosed and the above-noted crushing operation can be repeated until the new filter becomes saturated as determined by the counting out of the counter C.

Referring now to the embodiment of the control circuit as shown in FIG. 4, wherein like letters and numerals are employed to denote elements similar to those described in connection with the first embodiment, it will be noted that in this circuit the fuse 27 is connected in series with the motor M. The counter C is connected as in FIG. 3, but its switch contacts C1, which are now normally-open when the counter C is in its zero state or operating mode, are connected in series with the reset coil 41, a resistor 49, and the fuse 27 between lines L1 and L2. In addition, a relay R is connected in series with the fuse 27 between lines L1 and L2, and in parallel with normally-open relay switch R1 and a set of normally open switch contacts C2 controlled by the counter C. In this embodiment, and assuming that counter C has previously counted out so that switches C1 and C2 are now closed, and assuming that a new filter and fuse have been inserted in the apparatus, when the switch 43 is closed current flows through the now-closed switch C1, the reset coil 41, the resistor 49, and the fuse 27. The fuse 27, however, does not at this time burn out, because the current flow is limited by the resistor 49. However this current flow does cause the coil 41 to reset counter C, which in turn opens switches C1 and C2. At the same time the relay R is energized so that it closes the contacts R1, but no shunting of the fuse 27 takes place because switch contacts C2 are open at this time.

Thereafter lamps are inserted into tube 22 and the counter C is energized each time switch 45 is closed. When the counter C has reached its maximum, preset number, as for example when the filter 26 becomes saturated, the counter C counts out and closes switch C2, which is in series with the now-closed switch contacts R1, whereby the fuse 27 is shunted across lines L1 and L2 through the now-closed switches C2 and R1. This causes fuse 27 to blow, thus preventing further operation of the motor M until a new cartridge 26 is inserted in the bracket 18 and its leads 28 connected into the control circuit as shown in FIG. 4. Of course whenever a filter 26 is replaced, the switch 43 is moved to its open position until such time that the new filter cartridge is in place.

From the foregoing it will be apparent that, by utilizing a fuse 27 which forms part of the cartridge 26, means is provided for preventing operation of the motor M after a predetermined number of fluorescent lamps have been crushed by the equipment. While as shown in FIG. 3 a visual warning lamp 47 can also be utilized, it heretofore has often been ignored, either by accident or oversight, in which case it has been possible to overload a filter cartridge 26 with mercury vapors. With the present equipment, however, no such overloading of the cartridges will occur, because the equipment will shut down automatically as soon as a predetermined number of lamps have been crushed.

Referring again to FIG. 2, after a waste drum 11 has been filed, the drum cover is elevated to the position as shown in FIG. 2, thus exposing the excess midsection of sleeve 30. Then, by slightly lowering the cover 14, slack is created in the center of the sleeve, so that its midportion may be constricted and secured closed by a wire tie, or the like, thereby effectively sealing off the lower end 31 from the upper end 33 of the sleeve. The upper end 33 of the sleeve together with the disc 35 and clips 37 can then be slid downwardly off of the housing wall 24 and into the upper end of drum 11, which can then be sealed or closed off by a separate cover and properly disposed. The above operation, therefore, prevents any undesirable discharge of mercury vapors from drum 11 into the air during the removal of the filled rum 11. Thereafter a new drum 11 can be inserted onto carriage 12' after which a new sleeve 30 and associated disc 35 are mounted, respectively, on the annular housing wall 24 and the upper end of drum 11 as described above. Cover 14 is then lowered with the excess portion of the sleeve 30 entering the upper end of the drum, after which the crusher will be ready for operation.

From the foregoing it will be apparent that the present invention provides extremely safe and reliable means for preventing any undesirable escape of mercury vapors from a waste drum 11. By using a fuse in the manner of the type described above, the equipment also precludes accidental or negligent operation of the crusher after its associated filter cartridge 26 has become saturated or filled.

While this invention has been illustrated and described in connection with only certain embodiments thereof, it will be apparent that it is capable of still further modification, and that this application is intended to cover any such modifications as may fall within the scope of one skilled in the art or the appended claims.

I claim:

1. In a fluorescent lamp crusher apparatus of the type including a replaceable waste container closed at its upper end by a removable cover, and a housing having an inlet for accepting fluorescent lamp bulbs and an outlet for discharging crushed lamp particles into said waste container through an opening in said cover, the improvement comprising an extensible duct member releasably and sealingly secured at one end thereof to said outlet of said housing and at its opposite end to said upper end of said container and operative upon removal of said cover from said container to maintain a sealed connection between said outlet and said upper end of said container thereby to prevent escape of gas and dust from said container to the ambient atmosphere.

2. In a fluorescent lamp crusher apparatus of the type including a housing having an inlet for feeding fluorescent lamp bulbs one by one into said housing, a motor, a crushing member in said housing operable by said motor to break up the bulbs fed into said housing, and filter means including a replaceable filter cartridge for removing toxic gases released in said housing upon the destruction of said bulbs, the improvement comprising control means responsive to the insertion of a new filter cartridge in said filter means automatically to prevent the operation of said motor after said crushing member has destroyed a predetermined member of bulbs.

3. In fluorescent lamp crusher apparatus of the type including a replaceable waste container closed at its upper end by a removable cover, and a housing having an inlet for accepting fluorescent lamp bulbs and an outlet for discharging crushed lamp particles into said waste container through an opening in said cover, the improvement comprising extensible means releasably and sealingly connecting said outlet of said housing to said upper end of said container, and operative upon removal of said cover from said container to maintain a sealed connection between said outlet and said upper end of said container thereby to prevent escape of gas and dust from said container to the ambient atmosphere, said connecting mean comprising a plastic sleeve having open, opposed end, and means adjacent each of said opposed ends of said sleeve for releasably and sealingly connecting said opposed ends to said upper end of said waste container and to said outlet of said housing, respectively.

4. Apparatus of the type described in claim 3, wherein said means adjacent each of said opposed ends of said sleeve comprises a pair of elastic bands contained within folded portions of said sleeve adjacent said opposed ends thereof, one of said elastic bands sealingly connecting one end of said sleeve around said upper end of waste container, and the other of said elastic bands sealingly connecting the opposite end of said sleeve around said outlet of said housing.

5. Apparatus as defined in claim 3, wherein one of said open ends of said sleeve has a diameter larger than the diameter of the opposite end of said sleeve.

6. Apparatus as defined in claim 3, wherein an excess portion of said sleeve intermediate the ends thereof extends downwardly into said container when said cover is closed thereover, and protection means is positioned in said sleeve to prevent damage to said excess portion thereof during operation of said crusher apparatus.

7. Apparatus as defined in claim 6, wherein said protection means comprises a disk positioned in said sleeve and having therein a central opening releasably engaging said housing around said outlet, and means for removably maintaining said disk on said housing during operation of said apparatus.

8. Apparatus as defined in claim 7, wherein said means for maintaining said disk on said housing comprises a plurality of clips secured to said housing adjacent said outlet thereof, and operable to prevent said disk from sliding off said housing.

9. In fluorescent lamp crusher apparatus of the type including a housing having an inlet for feeding fluorescent lamp bulbs one by one into said housing, a motor, a crushing member in said housing operable by said motor to break up the bulbs fed into said housing, and filter means including a replaceable filter cartridge for removing toxic gases released in said housing upon the destruction of said bulbs, the improvement comprising control means responsive to the insertion of a new filter cartridge in said filter means automatically to prevent the operation of said motor after said crushing member has destroyed a predetermined number of bulbs, said control means comprising an electric circuit for supplying power to said motor, a fuse forming part of said cartridge and disposed to be connected in said circuit upon insertion of said cartridge in said filter means, and counter means in said circuit energizable upon the connection of said fuse in said circuit selectively to supply power to said motor until said predetermined number of bulbs have been destroyed.

10. Apparatus as defined in claim 9, including means in said circuit for blowing said fuse after energization of said counter means, whereby a new cartridge must be placed in said filter means to enable reenergization of said counter means following the destruction of said predetermined number of bulbs.

11. Apparatus as defined in claim 10, wherein said fuse blowing means includes means for blowing said fuse immediately following the energization of said counter means.

12. Apparatus as defined in claim 10, wherein said fuse blowing means includes means for blowing said fuse when said crushing member has destroyed said predetermined number of bulbs.

13. Apparatus as defined in claim 9, wherein said counter means comprises a presettable counter, a counter energizing coil connected in said circuit in series with said fuse, and operative upon being energized to preset said counter for said predetermined number of bulbs, and switch means controlled by said counter and operative upon the presetting of said counter intermittently to supply power to said motor until said predetermined number of bulbs have been destroyed.

14. In fluorescent lamp crusher apparatus of the type including a replaceable waste container at its upper end by a removable cover, a housing having an inlet for accepting fluorescent lamp bulbs, a crushing member in said housing operable to destroy the incoming bulbs one by one, an outlet in said housing for discharging crushed lamp particles into said waste container through an opening in said cover, and filter means including a replaceable filter cartridge for removing toxic gases from the housing, the improvement comprising an extensible duct member releasably and sealingly connected at one end thereof to said outlet of said housing, and at its opposite end to said upper end of said container, and operative upon removal of said cover from said container to maintain a sealed connection between said outlet and said upper end of said container thereby to prevent escape of gas and dust from said container to the ambient atmosphere, and means for controlling the operation of said crushing member, and operative each time a new filter cartridge is inserted into said filter means to enable operation of said crushing member only for a predetermined number of bulb destroying operations.

15. Apparatus as defined in claim 14, wherein said duct member comprises a plastic sleeve having open, opposed ends, and means adjacent each of said opposed ends for releasably and sealingly connecting said opposed ends of said sleeve to said upper end of said waste container and to said outlet of housing, respectively.

16. Apparatus as defined in claim 15, wherein an excess portion of said sleeve intermediate the ends thereof extends downwardly into said container when said cover is closed thereover, and protection means is positioned in said sleeve to prevent damage to said excess portion thereof during operation of said crusher apparatus.

17. Apparatus as defined in claim 14, including a motor for driving said crushing member, and an electric circuit for supplying power to said motor, and a fuse forming part of said cartridge and disposed to be connected in said circuit upon insertion of said cartridge in said filter means, and said means controlling the operation of said crusher member comprises counting means being connected in said circuit and energizable upon the connection of said fuse in said circuit selectively to supply power to said motor until said predetermined number of bulb destroying operations have been completed.

18. Apparatus as defined in claim 17, including means in said circuit for blowing said fuse after energization of said counting means, whereby a new cartridge must be placed in said filter means to enable reenergization of said counting means following the completion of said predetermined number of bulb destroying operations.

* * * * *